US006122458A

United States Patent [19]

Kita et al.

[11] Patent Number: 6,122,458

[45] Date of Patent: Sep. 19, 2000

[54] REPLACEABLE DEVELOPER SUPPLYING DEVICE AND REPLACEABLE IMAGING CARTRIDGE FOR AN IMAGE FORMING DEVICE

[75] Inventors: Nobuhiko Kita, Okazaki; Yasushi Tsuda; Yuzuru Sugimoto, both of Toyokawa, all of Japan

[73] Assignee: Minolta Co., Ltd., Osaka, Japan

[21] Appl. No.: 09/189,765

[22] Filed: Nov. 10, 1998

[30] Foreign Application Priority Data

Nov. 12, 1997 [JP] Japan ..... 9-310362
Nov. 12, 1997 [JP] Japan ..... 9-310844

[51] Int. Cl.[7] ..... G03G 15/08

[52] U.S. Cl. ..... 399/27; 399/106; 399/262

[58] Field of Search ..... 399/12, 13, 25, 399/27, 103, 106, 262, 263, 258; 222/DIG. 1

[56] References Cited

U.S. PATENT DOCUMENTS 5,506,665 4/1996 Ishida et al. .
5,568,237 10/1996 Ishida et al. .
5,708,912 1/1998 Lee ..... 399/24
5,745,822 4/1998 Nishimura et al. ..... 399/106

*Primary Examiner*—Joan Pendegrass
*Attorney, Agent, or Firm*—McDermott, Will & Emery

[57] ABSTRACT

In the present invention, a winder shaft of a toner supplying device and that of an imaging cartridge are coupled with gears, and a lock lever for locking rotation of gears is provided with the toner supplying device. Moreover, only when the imaging cartridge is attached to the toner supplying device, the lock lever is set released by a rib disposed for the imaging cartridge, whereby removals of seals for the toner supplying device and the imaging cartridge is made feasible. Thus, without accompanying fear that the seals are removed during storage, toner supplying device can be attached so as to supply toner when a toner in the imaging cartridge is used up.

21 Claims, 13 Drawing Sheets

REPLACEABLE DEVELOPER SUPPLYING DEVICE AND REPLACEABLE IMAGING CARTRIDGE FOR AN IMAGE FORMING DEVICE

This application is based on applications Nos. 9-310844, and 9-310362 filed in Japan, the contents of which are hereby incorporated by reference.

BACKGROUND OF THE INVENTION

1. Field of the Invention

The present invention relates to an electrophotographic image forming device such as a copier and a printer which is formed into a unit in the form of an imaging cartridge so that a component such as an image carrier can be easily attached and detached. More particularly, it relates to a developer supplying device, an imaging cartridge using this and an image forming device in which when developer in the imaging cartridge is reduced, the attachment of the developer supplying device allows the developer to be supplied.

2. Description of the Related Art

Some electrophotographic image forming devices are formed into a unit and used in the form of an imaging cartridge capable of easily replacing a component such as an image carrier having a life, a container for an expendable agent, developer, or the like. In this case, the longer the life of the whole imaging cartridge is, the more useful the device is. An attempt is therefore made to extend the life of the image carrier or the like and thus increase an amount of the developer contained in the imaging cartridge. However, the larger the amount of the contained developer is, the longer the period for which the developer is stirred in the container is, as a result. At a final stage of the life, the developer may be degraded due to too much stirring, and thus an image quality may deteriorate. Enabling the developer to be supplied to the imaging cartridge is therefore considered. However, in that case, developer must be adapted so that it does not fly around during the supply thereof or the like.

SUMMARY OF THE INVENTION

It is an object of the present invention to provide a developer supplying device capable of removing seal members of both of an imaging cartridge and the developer supplying device by one manual operation when the developer supplying device is attached to the imaging cartridge, or a developer supplying device having no danger of a developer flying due to the careless winding of the seal during being stored; an imaging cartridge capable of supplying the developer by the developer supplying device; and an image forming device using the developer supplying device and the imaging cartridge. Thereby, the followings are to be achieved: deterioration of image quality due to the over stirring of developer is prevented, and the life of the imaging cartridge can be extended.

A developer supplying device according to the present invention comprises: a first container for containing developer, having a first opening; a first seal member for closing the first opening and sealing the inside of the first container; first removing means for removing the first seal member and opening the first opening; and a first coupling member capable of coupling the first removing means to the outside.

An imaging cartridge according to the present invention includes: an image carrier having a surface on which an image of developer is formed; a second container for containing the developer to be provided to the image carrier, having a second opening; a second seal member for closing the second opening and sealing the inside of the second container; second removing means for removing the second seal member and opening the second opening; and a second coupling member capable of coupling the second removing means to the outside.

In the developer supplying device of the present invention, when the first removing means is driven, the first seal member is removed. Thereby, the sealed first opening is opened so that the developer contained in the first container can be supplied to the outside. Moreover, in the imaging cartridge of the present invention, when the second removing means is driven, the second seal member is removed. Thereby, the sealed second opening is opened so that the developer can be supplied from the outside to the second container.

Therefore, the developer supplying device according to the present invention is adapted so that it can be attached to the imaging cartridge according to the present invention. Then, the developer supplying device is attached to the imaging cartridge. In this state, preferably, the first opening faces to the second opening, and the first removing means is coupled to the second removing means. In this case, the developer supplying device can be considered to be an independent unit attachable to the imaging cartridge. Such a combination of the developer supplying device and the imaging cartridge is called an imaging device in the present application. The term "attachable" described herein may mean that once attached, the developer supplying device cannot be separated from the imaging cartridge.

Thus, the developer supplying device is attached to the imaging cartridge and then one removing means (the first or second removing means) is driven, whereby the other removing means (the second or first removing means) coupled to one removing means is also driven. Thus, the first and second seal members are removed by one operation. The first and second openings are then unsealed. At this time, since the first opening faces to the second opening, the developer contained in the first container can be moved into the second container. Thereby, the developer is supplied from the developer supplying device to the imaging cartridge.

In this imaging device, first, the image may be formed by the use of the developer alone in the second container of the imaging cartridge without the attachment of the developer supplying device to the imaging cartridge. Then, when the developer in the second container is running short, the attachment of the developer supplying device allows the developer to be supplied, whereby the image formation can be continued. Thus, the developer supplied from the developer supplying device is not always continuously stirred over the history of the use of the imaging cartridge. This prevents the deterioration of the developer due to the over stirring in the latter half of the life of the imaging cartridge. Moreover, the deterioration of the image quality can be prevented.

More preferably, in the developer supplying device and the imaging cartridge of the present invention, either the developer supplying device or the imaging cartridge (where either is acceptable) has driving means for driving the removing means (the first or second removing means). In this case, the developer supplying device is attached to the imaging cartridge and then one removing means (the first or second removing means) is driven by the driving means, whereby the other removing means (the second or first removing means) is also driven. Both the seal members (the first and second seal members) are thus removed by one operation. The developer can be therefore supplied from the developer supplying device to the imaging cartridge without obtaining a driving force from the main body of the image forming device using these.

The driving means may be a power source such as a motor. More preferably, the driving means is manually operable, for example, a knob and a handle. The driving means, which is always mounted to the developer supplying device or the imaging cartridge, is more useful because it has no fear of its loss.

In this case, preferably, one, having the driving means, of the developer supplying device and the imaging cartridge further includes: removal locking means for typically locking the drive of the removing means (the first or second removing means), the removal locking means being released by an external operation; and a cover member for covering the removal locking means, the cover member having an operation port for accepting the operation from the other (having no driving means, of the developer supplying device and the imaging cartridge), and the other of them includes: lock releasing means for releasing the removal locking means, wherein when the developer supplying device is attached to the imaging cartridge, the removal locking means is released by the lock releasing means.

In this manner, typically, i.e., when the developer supplying device is not attached to the imaging cartridge, the removal locking means locks the drive of the removing means (the first or second removing means). Thus, the removing means cannot be driven by the driving means. Since the removal locking means is covered with the cover member, it is not carelessly released. This prevents the contamination of surroundings resulting from the happening in which before the attachment, the removal of the (first or second) seal member causes the (first or second) opening to be opened and thus the internal developer flies around.

Then, when the developer supplying device is attached to the imaging cartridge, the lock releasing means of the other, i.e., either the developer supplying device or the imaging cartridge having no driving means enters the operation port of the cover member of the one, i.e., either the developer supplying device or the imaging cartridge having the driving means. The removal locking means is thereby released. The (first and second) seal members can be thus removed by driving the removing means by the driving means.

In the present invention, preferably, the developer supplying device includes a conductive member covered with the first seal member, and the imaging cartridge includes electrodes covered with the second seal member. When the developer supplying device comprising the conductive member is attached to the imaging cartridge comprising the electrodes, the electrodes are arranged so that they may be in contact with or adjacent to the conductive member. In this manner, when the developer supplying device is attached to the imaging cartridge so as to remove the first and second seal members, an electrical interaction is changed between the conductive member and the electrodes. Thus, an appropriate electric signal is extracted from the electrodes, whereby the signal can function as an attachment completion sensor.

In a preferred embodiment of these conductive member and electrodes, two electrodes are disposed, and the removal of the first and second seal members allows both the two electrodes to be brought into contact with the conductive member. Thereby, the completion of attachment can be sensed in accordance with whether or not continuity is detected between the two electrodes.

Preferably, the image forming device for forming the image by the use of this type of imaging cartridge and developer supplying device has first image formation disabling means for disabling the image formation until the developer supplying device is attached to the imaging cartridge, when an amount of developer in the imaging cartridge is a predetermined amount or less. The image forming device described herein means the device which uses the imaging cartridge, forms an image on the image carrier of the imaging cartridge, transfers the image to a recording material and forms the image. The first image formation disabling means is disposed in a control system of the image forming device.

In this manner, in the case where the imaging cartridge is attached to the image forming device (the developer supplying device is not yet attached) so as to form the image, when the developer in the imaging cartridge is reduced to less than a predetermined amount, the image formation is disabled by the first image formation disabing means. This prevents a faulty image formation due to a lack of the developer. When the attachment of the developer supplying device allows new developer to be supplied, the disablement by the first image formation disabling means is released. Thus, the image formation is again enabled.

More particularly, preferably, the imaging cartridge and the developer supplying device according to the present invention including the above-described electrodes and conductive member are used. In this case, when the developer supplying device is attached to the imaging cartridge so as to remove the first and second seal members, the appropriate electric signal is extracted from the electrodes, whereby the signal can function as the attachment completion sensor. This signal allows the disablement by the first image in formation disabling means to be released.

More preferably, the image forming device has second image formation disabling means for disabling the image formation until the imaging cartridge is replaced by a new one, when the amount of developer in the developer supplying device is a predetermined amount or less. In this case, when the developer is reduced to less than a predetermined amount by the subsequent image formation in spite of the supply of the developer to the imaging cartridge from the developer supplying device, the image formation is disabled by the second image formation disabling means. This prevents the faulty image formation due to the lack of the developer. The replacement of the imaging cartridge by the new one allows the disablement by the second image formation disabling means to be released. In this manner, the image formation is again enabled. This replacement is performed for the following reason. Namely, in the imaging cartridge which is used for such a long time that the developer in both of the imaging cartridge and the developer supplying device is used up, the image carrier or the like also often reaches to the end of its product life. It is therefore better that the imaging cartridge is replaced by the new one. The second image formation disabling means is also disposed in the control system of the image forming device.

Preferably, the developer supplying device of the present invention further includes: a support shaft rotatably disposed in the first container; and a flexible flap member mounted to the support shaft for rotating together with the support shaft and thereby moving the developer in the first container toward a surface (hereinafter referred to as an "opposite surface") on which the first opening is formed, wherein the flap member has inclined regions out of an opposite range opposite to the first opening, in which the farther from the first opening the flap member is, the shorter the distance between the support shaft and the end of the flap member is.

In this case, when the support shaft disposed in the first container is rotated with the flap member, the developer in the first container is pushed by the flap member and then collected toward the opposite surface. This urges the developer to be moved from the developer supplying device to the imaging cartridge via the first opening. Thus, when the developer supplying device is arranged not only over the imaging cartridge but also horizontally to the imaging cartridge, the developer can be supplied to the imaging cartridge without being left.

Furthermore, in the inclined region of the flap member out of the opposite range, the closer to the first opening the flap member is, the longer the distance between the support shaft and the end of the flap member is. Thus, a large amount of developer is pushed and resistance is high. Thus, in the inclined region, one portion of the flap member close to the first opening is rotated later than another portion of the flap member far from the first opening. Accordingly, a front surface of the flap member in the direction of rotation thereof is inclined and rotated so that it may be directed to the first opening. Thereby, the developer pushed by the flap member in the inclined region is scraped up toward the first opening. Therefore, the developer is collected toward the opposite surface by the rotation of the flap member while focusing on the first opening. This further urges the developer to be moved from the developer supplying device to the imaging cartridge via the first opening.

In this case, preferably, a slit is disposed on at least one border of the inclined region. Thereby when the flap member is rotated, the inclined region is more easily inclined. Thus, the more effect of scraping the developer in the inclined region toward the first opening is obtained.

Preferably, in the inclined region, a maximum distance between the support shaft and the end of the flap member is larger than the distance between the support shaft and the bottom surface of the first container. Thereby, when the flap member is rotated by the rotation of the support shaft, as long as there are not too much residual developer in the first container, the end of the flap member in the inclined region close to the first opening is brought into contact with the bottom surface of the first container. In this portion, all the developer is therefore pushed by the flap member and collected toward the opposite surface without remaining between the flap member and the bottom surface of the first container. Accordingly, the developer is more highly efficiently moved from the developer supplying device to the imaging cartridge.

In this case, a minimum distance between the support shaft and the end of the flap member may be larger or smaller than the distance between the support shaft and the bottom surface of the first container. If larger, over the inclined region, when the flap member is rotated (except when there are too much residual developer in the first container), the end thereof is brought into contact with the bottom surface of the first container. The effect, in which all the developer is collected toward the opposite surface without remaining between the flap member and the bottom surface of the first container, is thus obtained over the inclined region. Accordingly, the developer is more highly efficiently moved from the developer supplying device to the imaging cartridge.

If smaller, when the flap member is rotated, the end of the flap member is brought into contact with the bottom surface of the first container in only the inclined region close to the first opening (except when there are too much residual developer in the first container). Thus, there is a great difference in the resistance of rotation between the inclined region close to the first opening and the inclined region far from the first opening. Therefore, the inclined region is more strongly inclined. Thus, the more effect of scraping the developer in the inclined region toward the first opening is obtained.

Preferably, all the range of the flap member outside the opposite range is taken as the inclined region. Thereby, in the whole range outside the opposite range, the effect of scraping the developer toward the opening is obtained. Accordingly, the developer is more highly efficiently moved from the developer supplying device to the unit which the developer is supplied to.

In this manner, according to the present invention, there are provided a developer supplying device and an imaging cartridge which can manually easily remove the seal members of both of the imaging cartridge and the developer supplying device by one operation without contaminating the surroundings when the developer supplying device is attached to the imaging cartridge and which have no fear of the careless winding of the seal during being stored. Thereby, there are provided a developer supplying device, an imaging cartridge and an image forming device using these which prevent the deterioration of the image quality due to the over stirring of the developer while enabling the extension of the life of the imaging cartridge. There is also provided a developer supplying device which minimizes the residue of developer and enables the developer to be consumed without waste, regardless of the arrangement of the developer supplying device with respect to the imaging cartridge.

DETAILED DESCRIPTION OF THE PREFERRED EMBODIMENTS

An embodiment of the present invention will be described in detail below with reference to the accompanying drawings. This embodiment is an electrophotographic image forming device such as a copier and a printer. This device uses an imaging cartridge which is formed into a unit so that a component such as an image carrier can be easily attached and detached; and a toner supplying device which supplies a toner to the imaging cartridge when the toner in the imaging cartridge is reduced.

Figure 1:
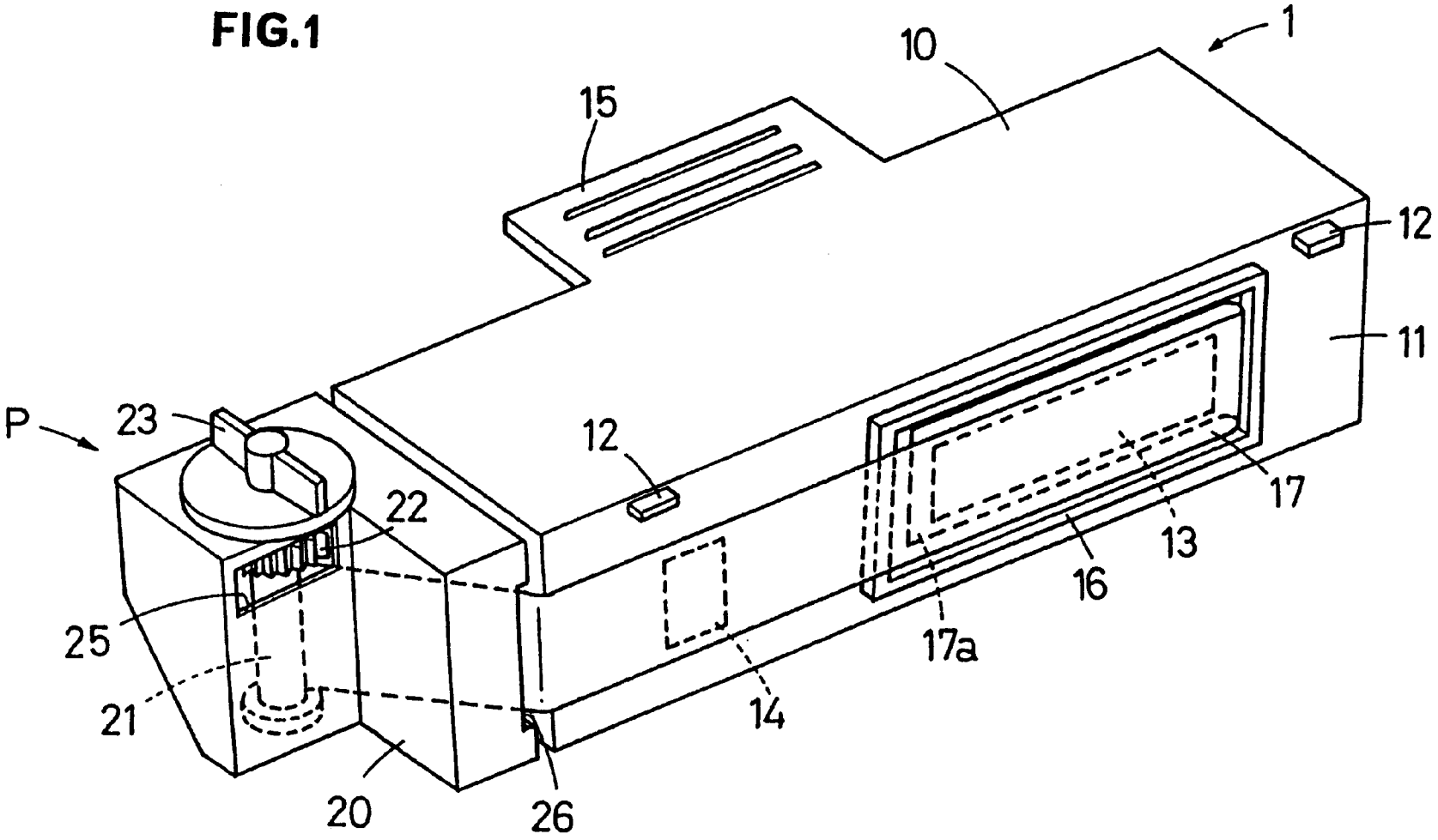
FIG. 1 shows a toner supplying device according to the embodiment.

In the first place, the toner supplying device will be described. As shown in FIG. 1, a toner supplying device 1 according to this embodiment has a schematically external form comprising a toner tank 10 and a winder 20 disposed on one side of the toner tank 10.

Most of a front surface 11 of the toner tank 10 is covered with a seal 17. A quadrilateral opening 13 is formed at the substantial center of the front surface 11 of the toner tank 10. A packing 16 composed of an elastic member is mounted around the opening 13. A metal pad 14 is mounted outside the packing 16 and near the winder 20. Juts 12, 12 are formed near both of the left and right ends on an upper side. The opening 13, the metal pad 14 and one side of the packing 16 near the winder 20 are covered with the seal 17. The remaining three sides of the packing 16 and the juts 12, 12 are not covered with the seal 17. A pressing portion 15 is formed on an upper portion on a rear surface of the toner tank 10.

Figure 2:
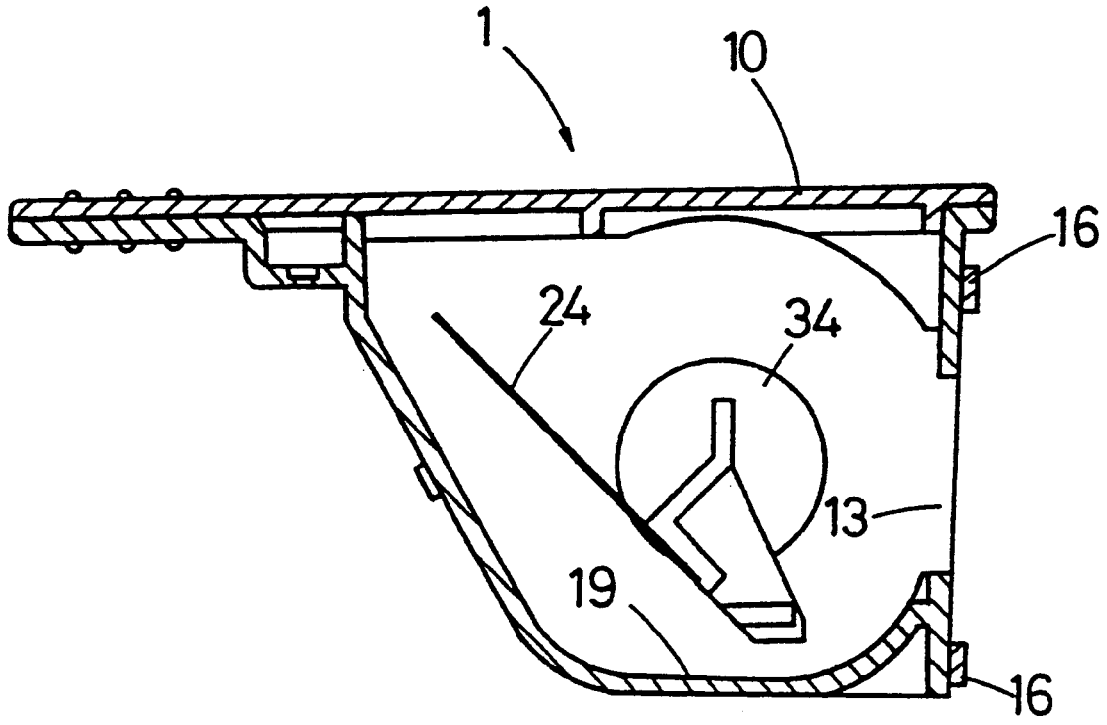
FIG. 2 is a cross sectional view showing inside of a toner tank.

This toner tank 10 is hollow and contains developer, the toner therein. As shown in a cross sectional view of FIG. 2, in the toner tank 10, an axially rotatable support shaft 34 is horizontally arranged parallel to the front surface 11. The support shaft 34 can be rotationally driven by a main body of the image forming device. A flapper 24 composed of a flexible film member is mounted to the support shaft 34 so that it may be rotated together with the support shaft 34.

Figure 3:
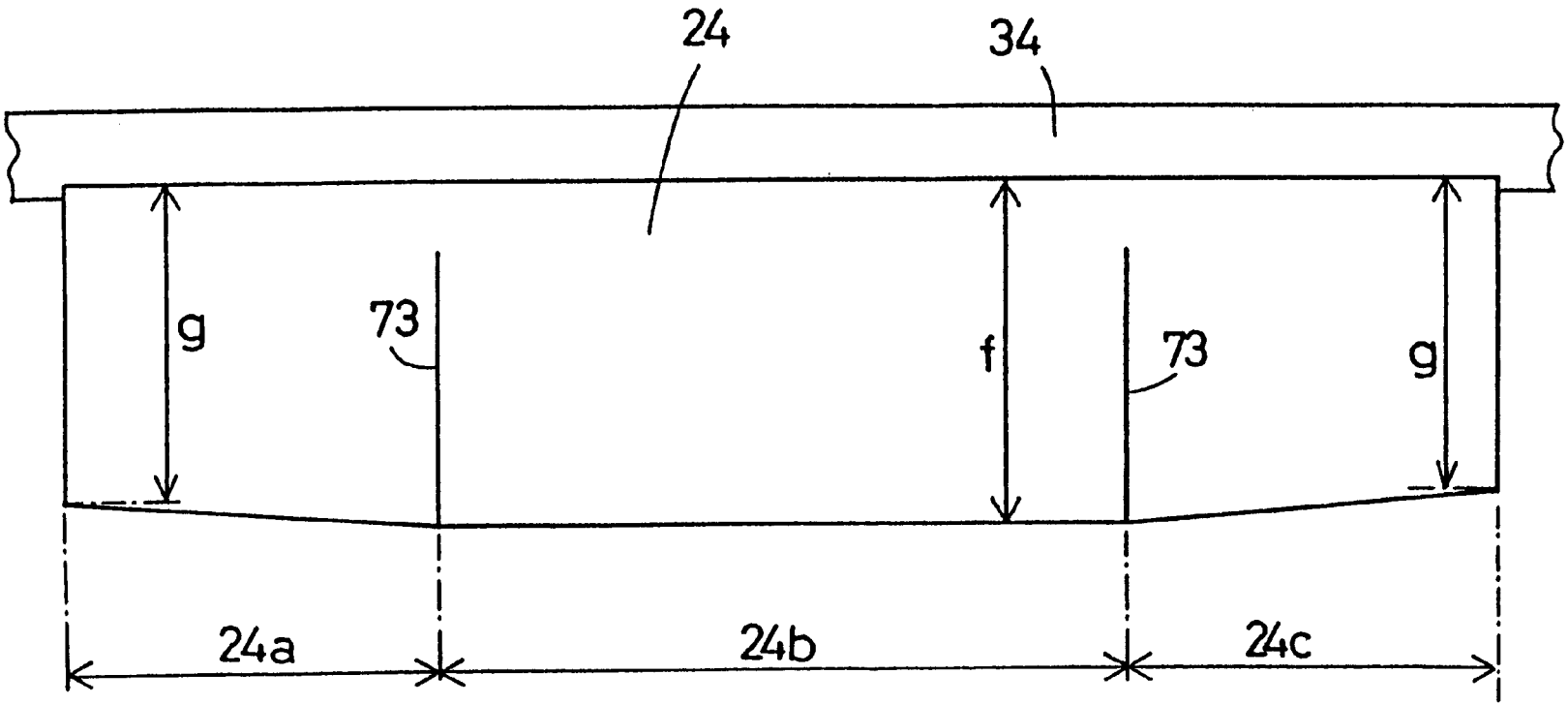
FIG. 3 is a plan view showing a flapper disposed inside of the toner tank.

As shown in a plan view of FIG. 3, the flapper 24 has a whole generally rectangular shape. The flapper 24 is divided into three sections 24*a*, 24*b* and 24*c* by slits 73, 73. The center section 24*b* is an opposite range corresponding to the range in which the opening 13 is formed on the front surface 11 of the toner tank 10. That is, the flapper 24 in the section 24*b* is opposite to the opening 13 on the side of an inner surface. In the section 24*b*, a length between the support shaft 34 and the end of the flapper 24 is fixed (f).

Figure 4:
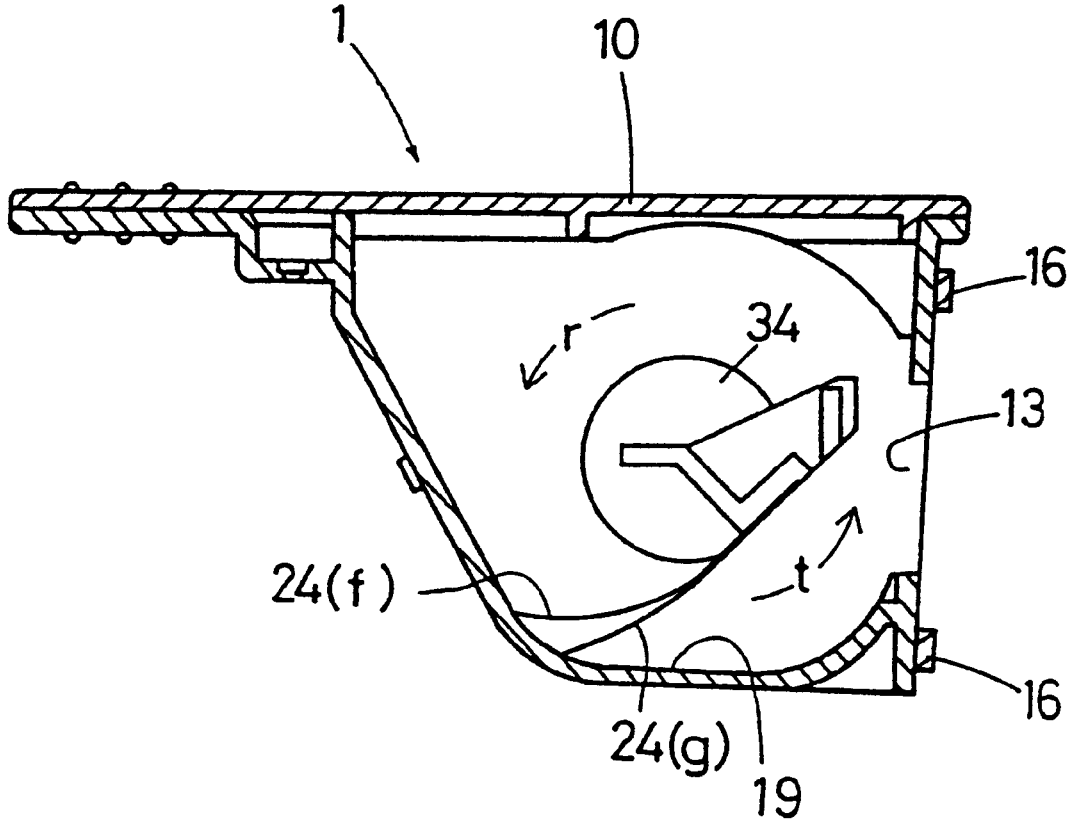
FIG. 4 is a cross sectional view showing a state that a flapper bends and contacts with inner bottom of the toner tank.

The sections 24*a* and 24*c* are located outside the opposite range. In these sections, the length between the support shaft 34 and the end of the flapper 24 is greatest in a portion adjacent to the section 24*b* through the slit 73. The farther from the section 24*b* the flapper 24 is, the shorter the length is. That is, the sections 24*a* and 24*c* are inclined regions disposed outside the opposite range. In these two inclined regions, the length between the support shaft 34 and the end of the flapper 24 has a maximum value (the length at the position closest to the center) which is equal to the length f in the section 24*b*. The length has a minimum value (the length on both the ends) which is g shorter than f. Both the lengths f and g are such that the end of the flapper 24 is brought into sufficient contact with a bottom inner surface 19 of the toner tank 10 when the flapper 24 is located at a lower position by the rotation of the support shaft 34 (see FIG. 4).

The winder 20 is also hollow but does not contain toner. A rotatable winder shaft 21 is vertically disposed in the winder 20. A gear 22 and a knob 23 are mounted on an upper end of the winder shaft 21. When the knob 23 is rotated, the winder shaft 21 and the gear 22 are rotated together. This knob 23 is disposed on an outer upper surface of the winder 20 so that it can be manually operated by a user. That is, the knob 23 is driving means for driving the winder shaft 21. On the other hand, since the gear 22 is not manually operated by the user, it is disposed inside the winder 20. It should be noted that a window 25 is formed on the front surface of the winder 20. The gear 22 is slightly protruded from this window 25. A vertically long slit 26 is formed on the front surface of the winder 20 very close to the toner tank 10.

One end of the seal 17 is bonded to the winder shaft 21. The other end 17a of this seal 17 is exposed to the outside through the slit 26, and the seal 17 covers most of the front surface 11 of the toner tank 10. In detail, the seal 17 is folded back inward, and the folded portion covers the opening 13 of the toner tank 10. The seal 17 is bonded to four sides of the opening 13 so that the opening 13 is sealed. Thereby, the toner in the toner tank 10 does not leak outward. However, the adhesion of the seal 17 to the four sides of the opening 13 is not so firm. This adhesion is such that the operation of the knob 23 allows the winder shaft 21 to be rotated whereby the seal 17 is easily peeled and wound around the winder shaft 21. That is, the winder shaft 21 is removing means for removing the seal 17 from the front surface 11 of the toner tank 10. As described above, the seal 17 also covers one side of the packing 16 and the metal pad 14.

Figure 5:
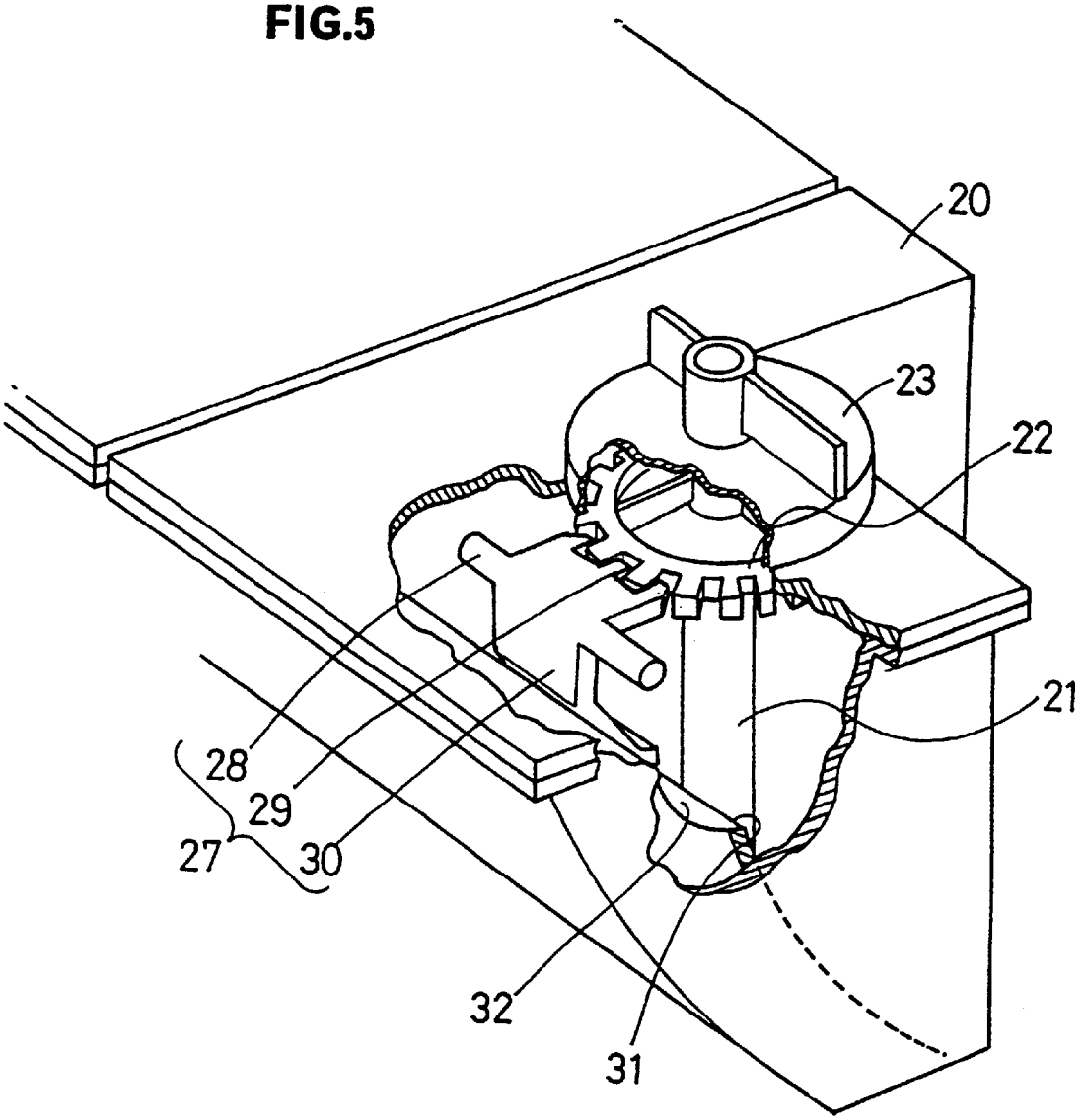
FIG. 5 shows inside of the toner supplying device with an outer frame being partially broken away, according to FIG. 1.
Figure 6:
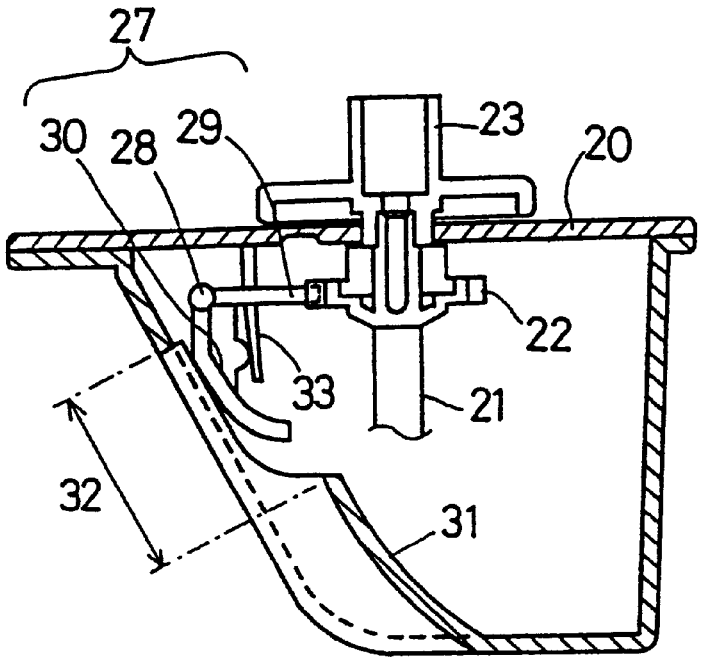
FIG. 6 is a cross sectional view showing inside of the toner supplying device according to FIG. 1 (in a locked state)

An internal mechanism of this winder 20 will be described with reference to FIGS. 5 and 6. FIG. 5 is an illustration of the winder 20 seen from the direction of an arrow P in FIG. 1, an outer frame being partially broken away. FIG. 6 is a cross sectional view of the winder 20. A lock lever 27 comprising a shaft 28, a rack 29 and an arm 30 is disposed in the winder 20 and behind the winder shaft 21. The rack 29 has mating teeth. This lock lever 27 is disposed so that it can be rotated about the shaft 28. A leaf spring 33 is suspended from the upper surface in the winder 20. A rear portion of the winder 20 is covered with a rear surface cover 31 so that the lock lever 27 may not be exposed to the outside. A slit 32 is longitudinally formed in the rear surface cover 31.

In such a winder 20, typically, as shown in the cross sectional view of FIG. 6, the arm 30 is applied to the inner surface of the rear surface cover 31 by a force applied by the leaf spring 33. In this state, the rack 29 is horizontally positioned and thus the arm 30 is directed downward. At this time, the mating teeth of the rack 29 are engaged with the gear 22. Thus, the rotation of the gear 22 (and the winder shaft 21 and the knob 23) is locked. That is, the lock lever 27 is removal locking means for locking the drive of the winder shaft 21.

However, the lock lever 27 is rotated about the shaft 28 so that the rack 29 can spring up. The mating teeth of the sprung rack 29 are disengaged from the gear 22, so that the gear 22 or the like can be rotated. More specifically, when the arm 30 is pushed from the lower left in FIG. 6, this occurs. However, unless any external member is inserted in the slit 32 so as to push the arm 30 by the force exceeding the force applied by the leaf spring 33, the lock lever 27 is not typically changed to such a state. That is, the slit 32 is an operation port for accepting an external operation of the lock lever 27.

Figure 7:
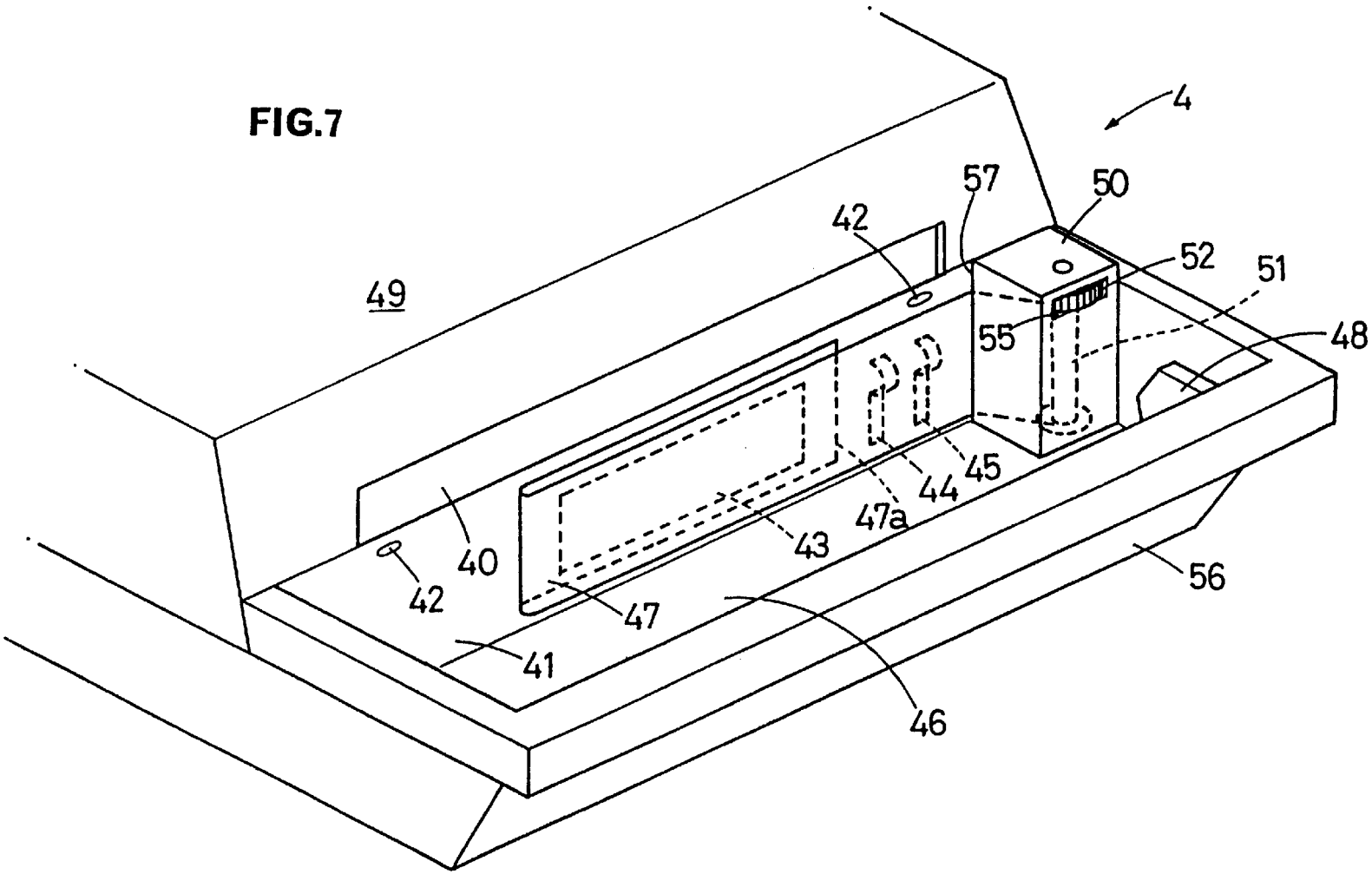
FIG. 7 shows main part of an imaging cartridge according to the embodiment.

Next, the imaging cartridge will be described. An imaging cartridge 4 according to this embodiment has the schematically external form, as its main part being shown in FIG. 7, comprising a toner tank 40, a tray 46 disposed in front of the toner tank 40 and a recovery tank 49 disposed on the toner tank 40.

Most of a front surface 41 of the toner tank 40 is covered with a seal 47. A quadrilateral opening 43 is formed at the substantial center of the front surface 41 of the toner tank 40. Contact electrodes 44 and 45 having no continuity therebetween are mounted on the right side of the opening 43 in FIG. 7. Recesses 42, 42 are formed near both of the left and right ends on the upper side. The opening 43 and the contact electrodes 44 and 45 are covered with the seal 47. The recesses 42, 42 are not covered with the seal 47. This toner tank 40 is hollow and contains developer, the toner therein.

The tray 46 is a portion for holding the above-described toner supplying device 1 in order to attach the device 1 thereto. A winder 50 is disposed in the tray 46 and close to the front surface 41 of the toner tank 40 on the right end in FIG. 7. A thin plate rib 48 is vertically mounted on a rear side of a front surface plate 56 of the tray 46 and at the position facing the winder 50.

The winder 50 is hollow but does not contain toner. A rotatable winder shaft 51 is vertically disposed in the winder 50. A gear 52 is mounted on the upper end of the winder shaft 51. The winder shaft 51 and the gear 52 are arranged so that they may be rotated together. Unlike the toner supplying device 1, the knob is not disposed. Since the gear 52 is not manually operated by the user, it is disposed inside the winder 50. It should be noted that a window 55 is formed on the front surface of the winder 50. The gear 52 is slightly protruded from this window 55. A slight gap 57 is disposed between the rear portion of the winder 50 and the front surface 41 of the toner tank 40.

One end of the seal 47 is bonded to the winder shaft 51. The other end 47a of this seal 47 is exposed to the outside through the gap 57, and the seal 47 covers most of the front surface 41 of the toner tank 40. In detail, the seal 47 is folded back inward, and the folded portion covers the opening 43 of the toner tank 40. The seal 47 is bonded to four sides of the opening 43 so that the opening 43 is sealed. Thereby, the toner in the toner tank 40 does not leak outward. However, the adhesion of the seal 47 to the four sides of the opening 43 is not so firm. This adhesion is such that the winder shaft 51 is rotated whereby the seal 47 is easily peeled and wound around the winder shaft 51. That is, the winder shaft 51 is the removing means for removing the seal 47 from the front surface 41 of the toner tank 40. As described above, the seal 47 also covers the contact electrodes 44 and 45.

Figure 8:
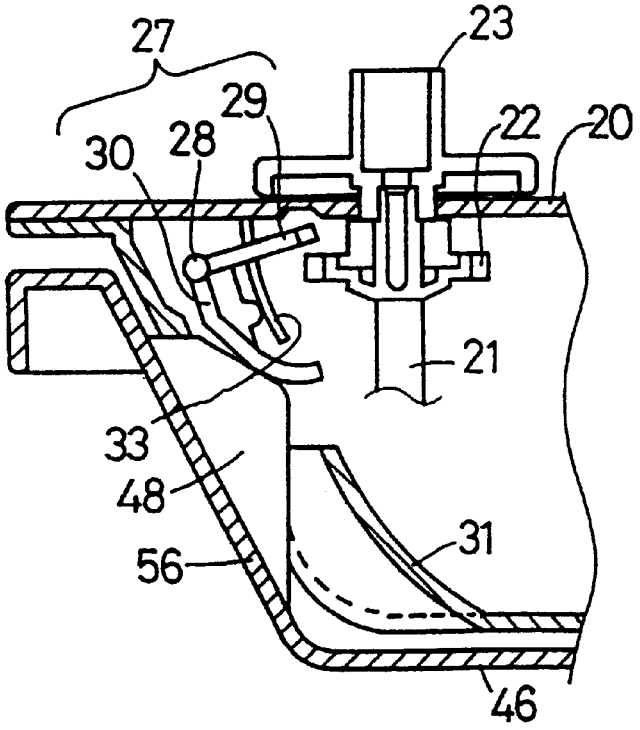
FIG. 8 is a cross sectional view showing inside of a toner supplying device according to FIG. 1 (in a lock-released state)

As described above, the toner supplying device 1 can be attached to the tray 46. During the attachment, the front surface 11 of the toner tank 10 of the toner supplying device 1 faces the front surface 41 of the toner tank 40 of the imaging cartridge 4. In that state, the juts 12, 12 of the toner supplying device 1 are fitted into the recesses 42, 42 of the imaging cartridge 4. The opening 13 of the toner tank 10 faces the opening 43 of the toner tank 40, with the seals 17 and 47 placed therebetween. The metal pad 14 also faces the contact electrodes 44 and 45, with the seals 17 and 47 placed therebetween. The gear 22 of the winder 20 is engaged with the gear 52 of the winder 50. Furthermore, the rib 48 of the tray 46 enters the slit 32 of the rear surface cover 31 of the winder 20 of the toner supplying device 1. Thus, as shown in FIG. 8, the arm 30 of the lock lever 27 is pushed by the rib 48 in the winder 20. Then, the rack 29 springs up so that the mating teeth of the rack 29 are disengaged from the gear 22. That is, the rib 48 is lock releasing means for releasing the lock of the rotation of the winder shaft 21 by the lock lever 27.

Figure 9:
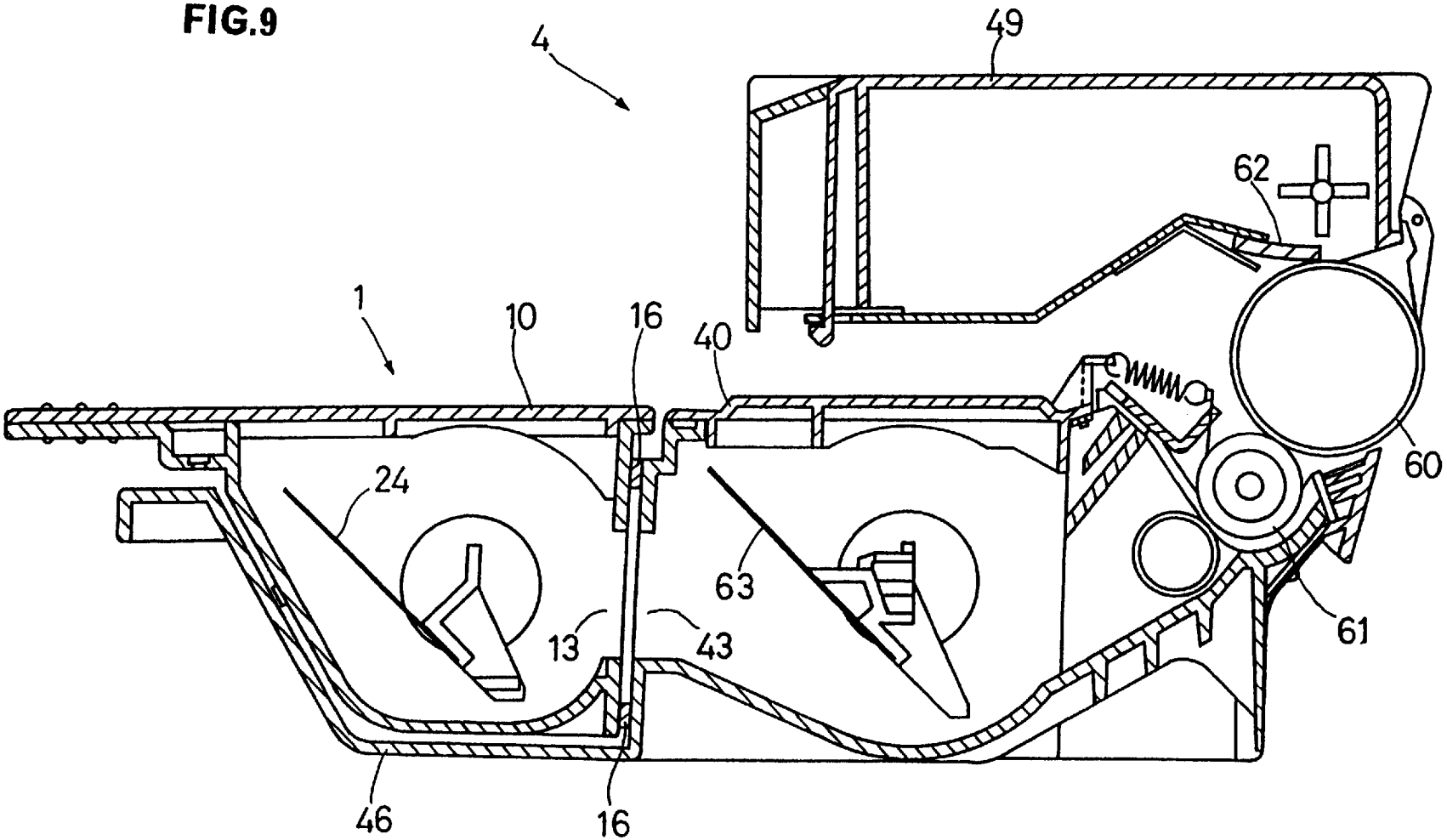
FIG. 9 is a cross sectional view showing inside of a toner supplying device according to FIG. 1 and that of an imaging cartridge according to FIG. 7.

As shown in FIG. 9, a photoreceptor drum 60, a developing roller 61, a cleaning blade 62 and the like are disposed in the rear portion (on the side opposite to the tray 46) of the imaging cartridge 4. The photoreceptor drum 60 is the image carrier having a surface on which a toner image to be transferred to a recording medium (a printing paper, etc.) is formed. The developing roller 61 is used for so forming the toner into the toner image by providing the toner in the toner tank 40 onto an electrostatic latent image on the photoreceptor drum 60. The cleaning blade 62 is a blade for removing the residual toner, paper powders or the like on the photoreceptor drum 60. The recovery tank 49 is a tank for recovering the residual toner, the paper powders or the like removed from the photoreceptor drum 60 by the cleaning blade 62. In the toner tank 40, a feeding film 63 for feeding the toner toward the developing roller 61 is disposed so that it can be axially rotated.

Figure 10:
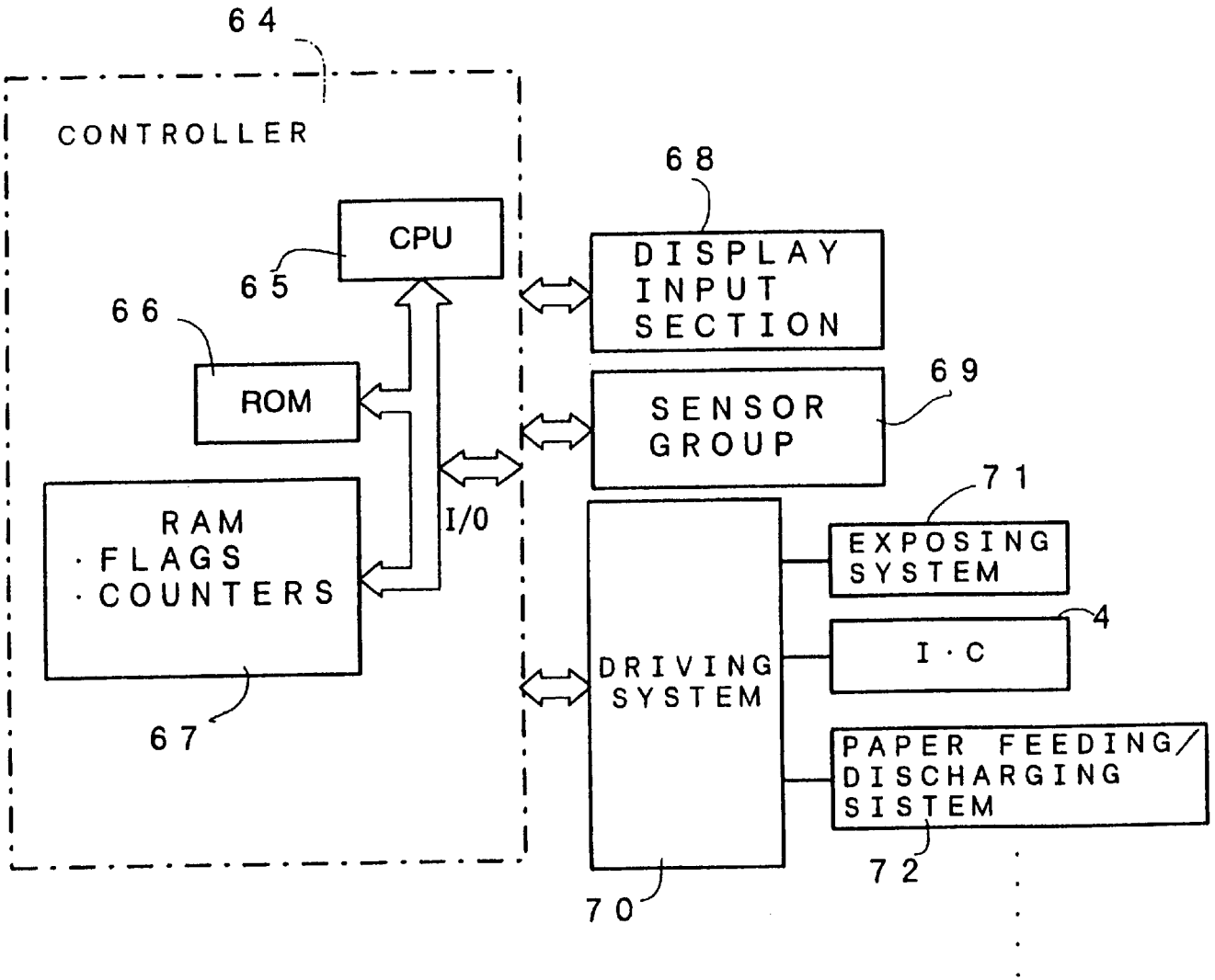
FIG. 10 is a block diagram showing the control system of an image forming device according to the embodiment.

The image forming device using the imaging cartridge 4 and the toner supplying device 1 includes a known paper feeding/discharging mechanism, exposing device or the like. The image forming device is used for forming the image by transferring the toner formed on the photoreceptor drum 60 of the imaging cartridge 4 to the recording medium. A control system of this device will be described. As shown in FIG. 10, this control system is generally divided into a controller 64, a display input section 68, a sensor group 69 and a driving system 70.

The controller 64 is used for controlling the whole image forming device. The controller 64 has a known CPU 65 for processing various operations, a known ROM 66 in which programs and data necessary for the processing are stored, and a known RAM 67 for temporarily storing various numerical values for the processing. The RAM 67 includes various flags and counters. One flag included in the RAM 67 is a print enabling flag. The print enabling flag is the flag for controlling whether or not the image formation is enabled. If the value of the flag is "0", the image formation is disabled. If the value of the flag is "1", the image formation is enabled.

The display input section 68 is a portion for displaying the operation status of the image forming device to the user and for inputting various condition settings and operation commands by the user.

The sensor group 69 includes various sensors having a function of sensing the states or the like of the portions of the image forming device and of informing the controller 64 of the states or the like. The sensor group 69 includes a cartridge sensor for sensing whether or not the imaging cartridge 4 is mounted; a toner sensor for sensing whether or not the residue of the toner in the toner tank 40 of the imaging cartridge 4 is a predetermined lower limit or more; a supplying device sensor for sensing whether or not the attachment of the toner supplying device 1 to the imaging cartridge 4 is completed; and so on. As described below, the supplying device sensor senses whether or not the attachment of the toner supplying device, 1 is completed in accordance with whether or not the continuity is detected between the contact electrodes 44 and 45 of the imaging cartridge 4.

The driving system 70 includes an exposing system 71, the photoreceptor drum 60 or the like of the imaging cartridge 4 (indicated by "IC" in FIG. 10 and similarly indicated in FIGS. 12 and 13), or an actuator of each portion such as a paper feeding/discharging system 72.

Next, the operation will be described. When the imaging cartridge 4 is attached to the body of the image forming device, the image can be formed. Until an amount of toner in the toner tank 40 is less than a predetermined lower limit, the image can be formed without attaching the toner supplying device 1 to the imaging cartridge 4.

First, the operation of the imaging cartridge 4 will be described. For the image formation, the photoreceptor drum 60 is rotated at a predetermined rotational speed while being subjected to processes such as charging and exposure by the image forming device body. Thereby, an electrostatic latent image is formed on the surface of the photoreceptor drum 60. Furthermore, toner is provided onto the electrostatic latent image by the developing roller 61, so that its toner image is formed. This toner image is transferred onto the recording medium fed in synchronization with the rotation of the photoreceptor drum 60 by the image forming device body. Furthermore, the image is fixed on the recording medium and consequently the image is formed. In this case, the feeding film 63 is axially rotated in the toner tank 40, whereby the toner in the toner tank 40 is stirred while being fed toward the developing roller 61. This operation is performed under the control of the controller 64.

When the toner in the toner tank 40 is consumed, reduced and finally less than a predetermined lower limit, the lack of the toner causes the image quality to be deteriorated. Thus, the toner must be supplied. Therefore, the toner supplying device 1 is attached to the imaging cartridge 4. This attachment is accomplished in the following manner. The toner supplying device 1 is placed on the tray 46 while the front surface 11 thereof faces the front surface 41 of the imaging cartridge 4. Then, the juts 12, 12 are fitted into the recesses 42, 42 while the pressing portion 15 is pushed downward, whereby the toner supplying device 1 is set. At this time, the opening 13 of the toner tank 10 faces the opening 43 of the toner tank 40, with the seals 17 and 47 placed therebetween. The metal pad 14 also faces the contact electrodes 44 and 45, with the seals 17 and 47 placed therebetween. The gear 22 of the winder 20 is engaged with the gear 52 of the winder 50. Furthermore, the rib 48 of the tray 46 enters the slit 32 of the rear surface cover 31 of the winder 20 of the toner supplying device 1. Thus, the arm 30 of the lock lever 27 is pushed by the rib 48 in the winder 20. Then, the rack 29 springs up so that the mating teeth of the rack 29 are disengaged from the gear 22. Thereby, the winder shaft 21 can be rotated.

Then, when the knob 23 of the winder 20 of the toner supplying device 1 is manually rotated by the user, the winder shaft 21 and the gear 22 are axially rotated. At this time, since the gear 22 is engaged with the gear 52, the rotation of the winder shaft 21 is transmitted to the winder 50 of the imaging cartridge 4. As a result, the gear 52 and the winder shaft 51 are axially rotated. This rotation of the winder shafts 21 and 51 allows the seals 17 and 47 to be wound around the winder shafts 21 and 51, respectively. Thus, the portions of the seals 17 and 47 covering the front surfaces 11 and 41 are pulled, so that the seals 17 and 47 are peeled and removed from the front surfaces 11 and 41. Thereby, the opening 13 of the toner tank 10 is communicated with the opening 43 of the toner tank 40 so that the toner can be moved from the toner tank 10 to the toner tank 40. This removal of the seals 17 and 47 by the operation of the knob 23 can be accomplished regardless of whether or not a power source of the image forming device body is turned on. In this case, a path, through which the toner moves from the toner tank 10 to the toner tank 40, is shut out from the outside by the packing 16 disposed around the opening 13. Thus, the moving toner does not spill outside.

Additionally, the removal of the seals 17 and 47 allows both the contact electrodes 44 and 45 to come into contact with the metal pad 14. Thus, the contact electrodes 44 and 45, which have had no continuity, have the continuity by removing the seals 17 and 47. Thereby, the supplying device sensor senses the completion of the attachment of the toner supplying device 1 to the imaging cartridge 4.

While the toner supplying device 1 is thus attached to the imaging cartridge 4, the toner supplying device 1 supplies the toner to the toner tank 40 of the imaging cartridge 4 in the following manner. That is, the support shaft 34 is driven by the body of the image forming device and rotated counterclockwise as indicated by an arrow r in FIG. 4. This rotation allows the flapper 24 to be rotated. When the flapper 24 is located at the position lower than the support shaft 34 by this rotation, the toner in the toner tank 10 is pushed out toward the opening 13 as indicated by an arrow t in FIG. 4. Thus, the toner collected in the opening 13 flows from the opening 13 into the toner tank 40 via the opening 43. In this manner, the toner is supplied.

At this time, as long as there are not too much residual toner, the end of the flapper 24 is brought into sufficient contact with the bottom inner surface 19 of the toner tank 10. Accordingly, all the developer is pushed out toward the opening 13 by the flapper 24 without the residual toner between the flapper 24 and the bottom inner surface 19. Thus, even if the residual toner in the toner tank 10 is reduced, the toner is highly efficiently moved from the toner tank 10 to the toner tank 40.

Since the flapper 24 includes the slits 73, 73 and the inclined region sections 24*a* and 24*c* described in FIG. 3, the following phenomenon occurs in the sections 24*a* and 24*c*. That is, in the sections 24*a* and 24*c*, the flapper 24 pushes out a large amount of toner in the long portion thereof near the center. Thus, a high friction is produced between the flapper 24 and the bottom inner surface 19. On the other hand, the flapper 24 pushes out a small amount of toner in the short portions thereof on both the ends. Thus, a low friction is produced between the flapper 24 and the bottom inner surface 19. In this manner, the long portion near the center differs from the short portions on both the ends in a load applied to the rotation. Thus, the high-loaded portion near the center is moved later than the low-loaded portions on both the ends.

Figure 11:
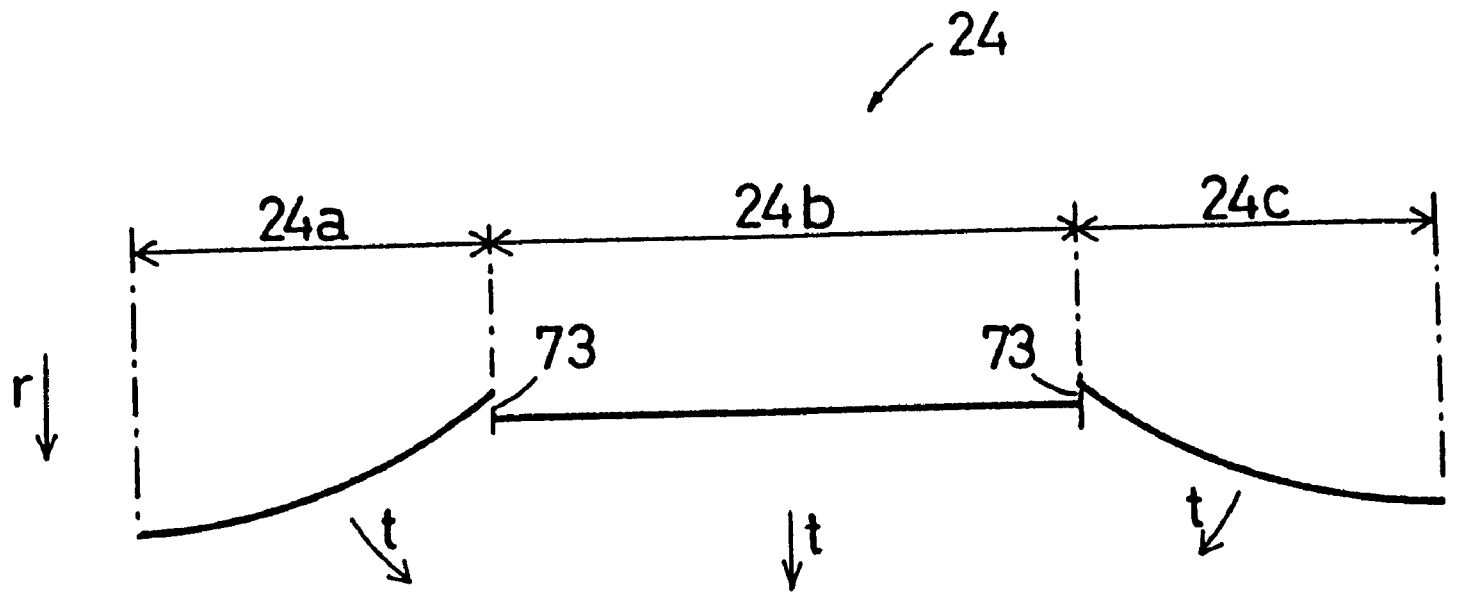
FIG. 11 is a schematic illustration showing inclination states of the flapper at inclined sections.

Thus, as shown in a schematic illustration of FIG. 11, the flapper 24 is inclined in the sections 24*a* and 24*c*. In FIG. 11, the arrows r and t indicate the direction of movement of the flapper 24 due to the rotation and the direction of movement of the toner pushed by the flapper 24, respectively. The arrows r and t in FIG. 11 correspond to the arrows r and t in FIG. 4. As can be seen from FIG. 11, the toner pushed by the flapper 24 in sections 24*a* and 24*c* is collected inward, i.e., toward the opening 13 due to the inclination. Thereby, the toner outside the range corresponding to the opening 13 also focuses on the range. Finally, the toner is moved from the opening 13 to the toner tank 40.

In this way, almost all the toner contained in the toner tank 10 of the toner supplying device 1 is moved to the toner tank 40 of the imaging cartridge 4. Thereby, the toner is supplied to the imaging cartridge 4. This toner supplied from the toner supplying device 1 is not continuously stirred from the beginning of the use of the imaging cartridge 4. Thus, this toner is a fresh toner which is not deteriorated due to the over stirring. By the fresh toner supplied from the toner supplying device 1, the image formation can be therefore continued keeping the image quality equivalent to the quality at the beginning of the use of the imaging cartridge 4. In this state, in the image formation, both of the feeding film 63 of the toner tank 40 and the flapper 24 of the toner tank 10 are axially rotated, whereby the toner in the toner tank 10 is stirred while being fed toward the developing roller 61.

Next, a control flow of the controller 64 controlling the above-mentioned image formation will be described by the use of a flow chart. A main routine of the controller 64 is as shown in the flow chart of FIG. 12. This routine starts by turning on the power source of the image forming device. First, a predetermined initialization (including each self-diagnosis or the like) is performed (S1). A timer is started (S2). Then, the status of the imaging cartridge 4 is sensed (S3). In step S3, the attachment of the imaging cartridge 4 and the toner supplying device 1 is checked; whether or not the residue of the toner is a predetermined lower limit or more is checked; and the value of the print enabling flag in the RAM 67 is determined in accordance with the check result, i.e., whether or not the image formation is enabled is determined. The processing in step S3 is executed as a subroutine. The detail will be described below with reference to FIG. 13.

Subsequently, the image formation processing is performed (S4). That is, if the image formation is "enabled" in S3 and an image formation command is entered, the image formation processing is performed. If the image formation is "disabled" in S3 or if the image formation command is not entered, the image formation processing is not performed. Next, a postprocessing is performed (S5). The main content includes a recovery processing which is performed if any error is caused, or the like. When this processing is terminated, the timer is checked (S6). If time is up (S6: Yes), the processing is returned to S2 and the processing is performed again. This processing from S2 to S6 is repeated within a cycle time of about 10 msec. The above processing is the main routine.

Figure 13:
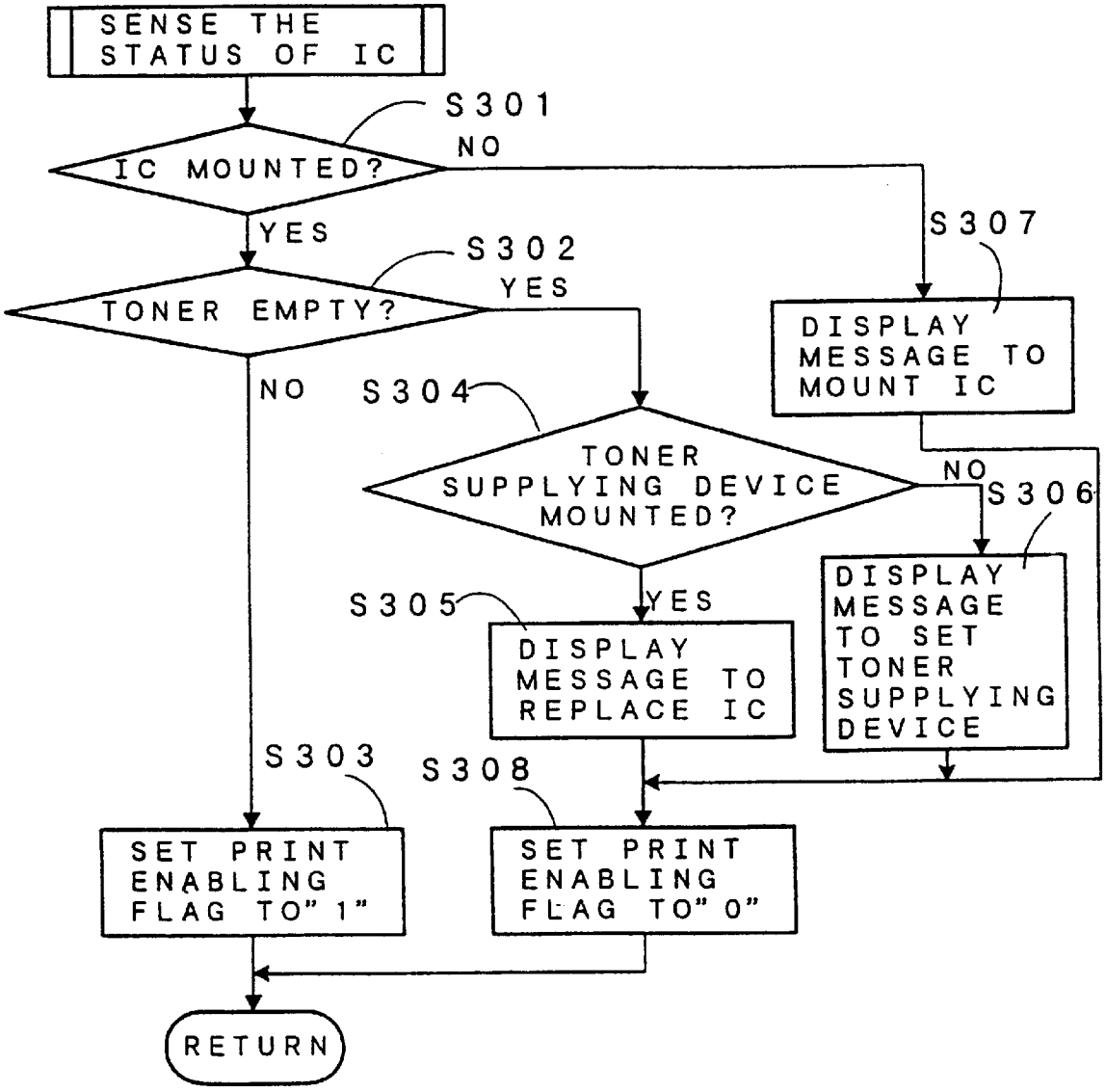
FIG. 13 is a flow chart showing a subroutine for sensing state of an imaging cartridge.

Next, the content of the processing for sensing the status of the imaging cartridge 4 in the above-described step S3 will be described with reference to the flow chart of FIG. 13.

(S301)

First, whether or not the imaging cartridge 4 is mounted to the image forming device is checked. This check is carried out by a sensing signal from one of the sensor group 69, the cartridge sensor. If the imaging cartridge 4 is mounted to the image forming device (Yes), the processing proceeds to S302. If the imaging cartridge 4 is not mounted to the image forming device (No), the processing proceeds to S307.

(S302, S303)

If the imaging cartridge 4 is mounted to the image forming device, whether or not the toner tank 40 is empty is in checked (S302). This check is carried out by the sensing signal from one of the sensor group 69, the toner sensor. That is, if the residue of toner in the toner tank 40 is a predetermined lower limit or more, the toner tank is not empty (No). If the residue of toner is less than a predetermined lower limit, the toner tank is empty (Yes). If the toner tank is not empty (No), the processing proceeds to S303 and the print enabling flag is set to "1". That is, since the residue of toner is sufficient, the image formation is "enabled". If the toner tank is empty (Yes), the processing proceeds to S304.

(S304)

If the toner tank 40 is empty, whether or not the toner supplying device 1 is mounted to the imaging cartridge 4 is checked. This check is carried out by the sensing signal from one of the sensor group 69, the supplying device sensor. More specifically, if the continuity is detected between the contact electrodes 44 and 45 of the imaging cartridge 4, the toner supplying device 1 is mounted to the imaging cartridge 4 (Yes). If no continuity, the toner supplying device 1 is not mounted to the imaging cartridge 4 (No). That is, only when the seals 17 and 47 are removed and the attachment of the toner supplying device 1 to the imaging cartridge 4 is completed, the determination is made that the toner supplying device 1 is mounted to the imaging cartridge 4. If the toner supplying device 1 is mounted to the imaging cartridge 4 (Yes), the processing proceeds to S305. If the toner supplying device 1 is not mounted to the imaging cartridge 4 (No), the processing proceeds to S306.

(S305, S306)

If the toner supplying device 1 is mounted to the imaging cartridge 4, a message to replace the imaging cartridge 4 by a new one is displayed (S305). This message is displayed by the display input section 68. This message is displayed for the following reason. That is, this case indicates that the toner in the toner tanks 40 and 10 is used up. In other words, the photoreceptor drum 60 or the like of the imaging cartridge 4 is also used for a considerably long time and already reaches to the end of its product life. On the other hand, if the toner supplying device 1 is not mounted to the imaging cartridge 4, the message to set the toner supplying device 1 on the imaging cartridge 4 is displayed (S306). This message is also displayed by the display input section 68. This message is displayed for the following reason. That is, this case indicates that the toner in the toner tank 40 is used up but the toner in the toner tank 10 is not yet used. In other words, the supply of the toner by the toner supplying device 1 allows the image formation.

(S307)

If the imaging cartridge 4 is not mounted to the image forming device in S301, the message to mount the imaging cartridge 4 to the image forming device body is displayed. This message is also displayed by the display input section 68.

(S308)

When any message of S305 through S307 is displayed, the print enabling flag is set to "0". That is, since the residue of the toner is lacking or the imaging cartridge 4 itself is not mounted, the image formation is "disabled".

Figure 12:
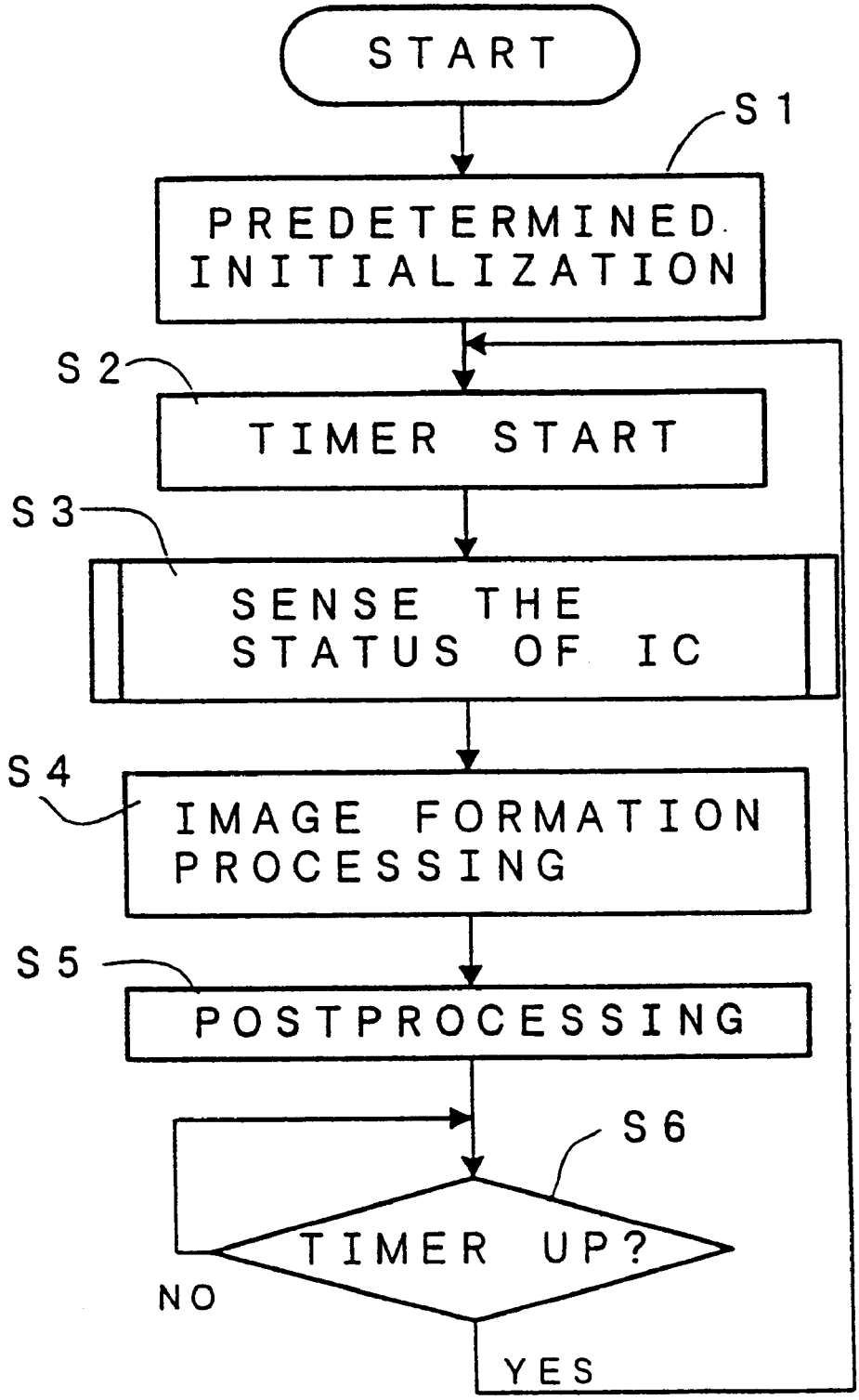
FIG. 12 is a flow chart showing main routine for operation of an image forming device according to the embodiment.

When the print enabling flag is set in either S303 or S308, the processing is returned to the main routine of FIG. 12 and then the image formation processing from S4 is performed. That is, when "1" is set in S303, if the image formation command is entered, the image formation processing is performed in S4. However, when "0" is set in S308, until the print enabling flag is changed, the image formation processing is not performed in spite of the entry of the image formation command.

When the image forming device having the above-described control flow is actually used, the following phenomenon occurs. First, when the imaging cartridge 4 is not attached, "No" is determined in S301 of the flow of FIG. 13. In S307, the message to mount the imaging cartridge 4 is displayed. Then, in S308, the print enabling flag is set to "0". Therefore, the image formation is not performed in this state. When the new imaging cartridge 4 is attached, "Yes" is determined in S301 and "No" is determined in S302. In S303, the print enabling flag is set to "1". Accordingly, if the image formation command is entered, the image formation can be performed.

When the repetition of the image formation causes the toner to be consumed and thus the residue of the toner is less than the lower limit value, "Yes" is determined in S302. Since the toner supplying device 1 is not yet mounted at this time, "No" is determined in S304. Thus, in S306, the message to set the toner supplying device 1 is displayed. In S308, the print enabling flag is set to "0". Thus, the image formation cannot be performed. When the toner supplying device 1 is attached, the new toner is supplied and thus "No" is determined in S302. In S303, the print enabling flag is set to "1", so that the state enabling the image formation is recovered. Thus, the image formation can be continued by the use of the high-quality toner which is not excessively stirred. That is, when the residue of the toner in the toner tank 40 of the imaging cartridge 4 is less than the lower limit value, the image formation is disabled until the toner supplying device 1 is set.

When the further repetition of the image formation causes the toner to be consumed and thus the residue of the toner is less than the lower limit value, "Yes" is determined again in S302. Since the toner supplying device 1 is mounted at this time, "Yes" is determined in S304. Thus, in S305, the message to replace the imaging cartridge 4 by the new one is displayed. In S308, the print enabling flag is set to "0". Thus, the image formation cannot be performed. When the old imaging cartridge 4 is detached, the determination is changed to "No" in S301. The message is also changed to the message to mount the imaging cartridge 4. When the new imaging cartridge 4 is mounted, the image formation is enabled again. That is, when the residue of the toner in the toner tank 10 of the toner supplying device 1 is less than the lower limit value, the image formation is disabled until the imaging cartridge 4 is replaced by the new one.

As described in detail above, according to this embodiment, the winder shaft 21 of the toner supplying device 1 includes the gear 22, and the winder shaft 51 of the imaging cartridge 4 also includes the gear 52. When the toner supplying device 1 is mounted to the imaging cartridge 4, the gear 22 is engaged with the gear 52. Thus, both the seals 17 and 47 of the toner supplying device 1 and the imaging cartridge 4 can be removed by one operation, i.e., the rotation of the knob 23 of the toner supplying device 1. This operation can be performed regardless of whether or not the power source of the image forming device body is turned on. Since the knob 23 is always attached, it is not lost during being stored and thus it is useful.

Moreover, the lock lever 27 is disposed behind the winder shaft 21 of the toner supplying device 1 so that the mating teeth of the rack 29 are engaged with the gear 22. The leaf spring 33 applies the force to the engagement of the lock lever 27. This engagement is covered with the rear surface cover 31. Thus, unless any external member is intentionally inserted in the slit 32 of the rear surface cover 31 so as to push the arm 30 of the lock lever 27 by the force exceeding the force applied by the leaf spring 33, the seal 17 is not removed and the internal toner does not spill when the toner supplying device 1 is stored. In the imaging cartridge 4, the winder shaft 51 does not include the knob. Thus, the seal 47 is not removed and the internal toner is not jetted before the toner supplying device 1 is mounted.

The rib 48 is disposed on the tray 46 of the imaging cartridge 4. When the toner supplying device 1 is mounted, this rib 48 enters the slit 32 of the rear surface cover 31 so that the lock lever 27 is unlocked. Thus, when the toner supplying device 1 is mounted, the seals 17 and 47 can be removed by operating the knob 23 without any troubles. Moreover, the packing 16 is disposed around the opening 13 of the toner tank 10 of the toner supplying device 1. Thus, when the toner supplying device 1 is mounted to the imaging cartridge 4 and the seals 17 and 47 are removed, the path, through which the toner moves from the toner tank 10 to the toner tank 40, is shut out from the outside by the packing 16. This prevents the toner from spilling from this path.

In this manner, each of the imaging cartridge 4 and the toner supplying device 1 can be formed into an independent unit. The combination of these can be also provided in the form of the imaging device. Thereby, at the beginning of the use, the imaging cartridge 4 alone is mounted to the image forming device body for the image formation. When the toner of the imaging cartridge 4 is reduced, the toner supplying device 1 can be mounted so as to supply the toner. Thereby, the image formation can be continued by the use of the high-quality toner which is not deteriorated due to the over stirring.

Furthermore, the toner supplying device 1 includes the metal pad 14 covered with the seal 17, and the imaging cartridge 4 includes the contact electrodes 44 and 45 covered with the seal 47. When the toner supplying device 1 is mounted to the imaging cartridge 4, the metal pad 14 and the contact electrodes 44, 45 are arranged so that they may face each other with the seals 17 and 47 placed therebetween. When the seals 17 and 47 are removed, the contact electrodes 44, 45 have the continuity through the metal pad 14. Thus, whether or not the attachment of the toner supplying device 1 to the imaging cartridge 4 is completed can be sensed in accordance with whether or not the continuity is detected between the contact electrodes 44 and 45.

In the image forming device using these, when the residue of the toner is less than a predetermined lower limit, the image formation is disabled. If the toner supplying device 1 is not mounted, the message to mount this device is displayed. Thus, there is provided an image forming device in which when the image is formed without mounting the toner supplying device 1 to the imaging cartridge 4 and the residue of the toner is less than the lower limit, the image formation is disabled until the attachment of the toner supplying device 1 is completed, whereby the faulty image formation due to the lack of the toner is prevented.

Moreover, when the residue of the toner is less than a predetermined lower limit and the image formation is disabled, if the toner supplying device 1 is mounted, the message to replace the imaging cartridge 4 by the new one is displayed. Thus, there is provided an image forming device in which when the image is formed with the toner supplying device 1 mounted to the imaging cartridge 4 and the residue of the toner is less than the lower limit, the image formation is disabled until the imaging cartridge 4 is replaced by the new one, whereby the faulty image formation due to the lack of the toner and the end of the life of the photoreceptor drum 60 is prevented.

The present embodiment is an example and does not limit the present invention in any respect. Accordingly, the present invention can be variously improved and changed within the scope not departing from the subject matter thereof.

For example, the openings 13, 47 are disposed at substantially center of the front surfaces 11, 41 of the toner tanks 10, 40, respectively, in this embodiment, however the disposition of those items is not restricted to central part but may be other positions. Further, the shapes of the openings are not restricted to quadrilateral but may be other shapes. Incidentally, the knob 23 and the lock lever 27 for removing the seals 17, 47 are disposed on the toner supplying device 1 and the rib 48 for releasing the lock lever 27 is disposed on the imaging cartridge 4 in this embodiment, however, these combinations of the dispositions may be changed. That is, a knob and a lock lever may be disposed on the imaging cartridge 4, and an item corresponding to a rib on the toner supplying device 1. Similarly, the packing 16 may be disposed to the imaging cartridge 4 instead of the toner supplying device 1, or to both of them.

The gears 22, 52 for transmitting driving between the toner supplying device 1 and the imaging cartridge 4 may be replaced with other driving-transmission structure such as rollers. The gear 22 may not necessarily be disposed in coaxial to the knob 23: a certain driving-transmission structure may exist. Further, the driving may be led to the developing roller 61, whereby bias voltage of development is adjusted. At the time when the toner supplying device 1 is attached, photosensitive layer of the photoreceptor drum 60 has been thinner than new one and therefore, optimum value of the bias voltage is considered to have changed. Alternatively, this driving may be led to a cleaning device disposed for various devices (for charging, development, transfer or the like) around the photoreceptor dram 60 so that those devices may be cleaned simultaneously. Moreover, although supply of toner to the imaging cartridge 4 by the toner supplying device 1 is carried out only once in this embodiment, the supply may be done more than twice.

Further, as to check toner empty (S302) for disabling image forming operation, the check may be made by counting cumulative number of times of image formation, wherein it is decided as toner empty when the number of times for image formation reaches a predetermined number of times instead of sensing the residue of toner. In case that the number of times of image formation reaches the predetermined number of times, a counter may be reset at the time the imaging cartridge 4 is replaced with a new one. Moreover, the state of toner empty may be decided by both sensing the residue of toner and counting cumulative number of times for image formation simultaneously: when either of them reaches its predetermined amount or the number of times, the state of toner empty is decided. Still alternatively, check of presence/absence of the imaging cartridge 4 may be replaced with check of toner empty. The display for disabling image formation operation (S305, S306, S307) may be executed when returning to the main routine (FIG. 12) by arranging appropriate flags in the subroutine instead of processing the display at the subroutine in FIG. 13.

Figure 14:
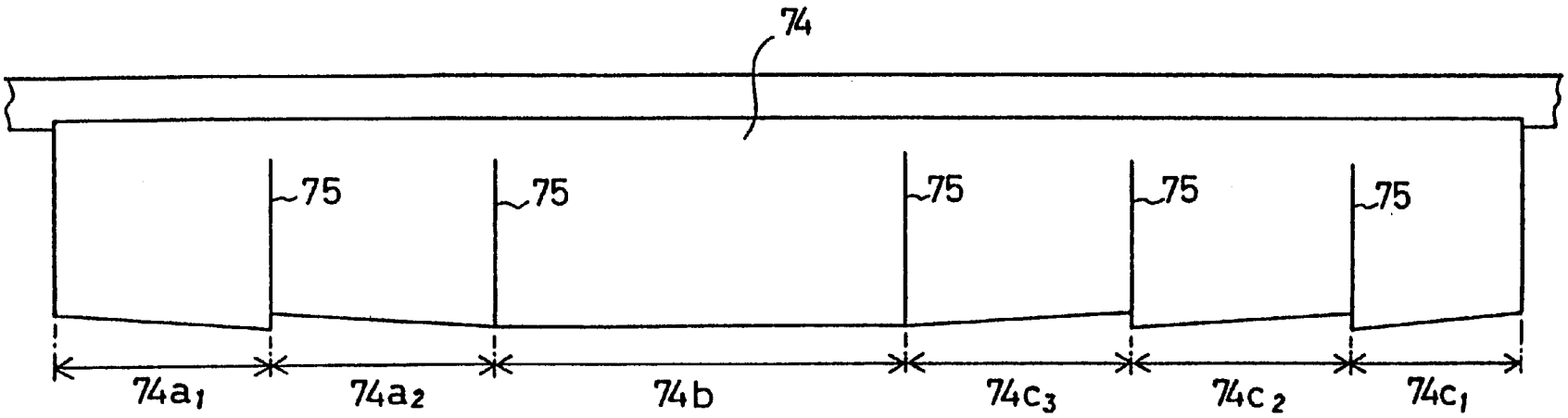
FIG. 14 is a plan view of a flapper according to a variant.

Further, all the range of flapper 24 outside the opposite range 24*b* is taken as each single inclined region in this embodiment, however, arrangement of inclined region is not restricted to the above: a part outside the opposite range 24*b* may be taken as inclined region. Alternatively, plurality of inclined region may be arranged outside the opposite range 24. FIG. 14 shows an example of it, wherein a flapper 74 has five slits. In detail, 74$a_1$, and 74$a_2$ are at one side and 74$b_1$, 74$b_2$, and 74$b_3$ at the other side, whereby five sections of inclined region are arranged.

What is claimed is:

1. A developer supplying device which is attachable to a developing device having a first opening sealed with a first seal member, comprising:

a container for containing developer, said container having a second opening;

a second seal member for closing the opening and sealing the inside of the container; and a seal-removing mechanism for transmitting driving force to the second seal member to unseal the second opening, said seal-removing mechanism being coupled with the developing device when the developer supplying device is attached to the developing device;

wherein the seal-removing mechanism unseals the first seal member which covers the first opening in concurrence with unsealing the second opening.

2. The developer supplying device according to claim 1, further including a manual-driving member which is operated manually for generating the driving force for driving the removing means.

3. A developer supplying device comprising:

a container for containing developer with the container having an opening;

a seal member for closing the opening and sealing the inside of the container;

removing means for removing the seal member and opening;

a coupling member capable of coupling the removing means to a member outside said developer supplying device; and a conductive member covered with the seal member.

4. An imaging cartridge, to which a developer supplying device having a first opening sealed with a first seal member is attachable, comprising:

an image carrier having a surface on which an image of developer is formed;

a container for containing developer to be provided to the image carrier, said container having a second opening;

a second seal member for closing the second opening and sealing the inside of the container; and a seal-removing mechanism for transmitting driving force to the second seal member to unseal the second opening, said seal-mechanism being coupled with the developer supplying device when the developer supplying device is attached to the imaging cartridge;

wherein the seal-removing mechanism unseals the first seal member which covers the first opening in concurrence with unsealing the second opening.

5. The imaging cartridge according to claim 4 further including a manual-driving member which is operated manually for generating the driving force.

6. The imaging cartridge according to claim 4, wherein the developer supplying device further has a manual-driving member which is operated manually for generating the driving force.

7. An imaging cartridge comprising:

an image carrier having a surface on which an image of developer is formed;

a container for containing developer to be provided to the image carrier, said container having an opening;

a seal member for closing the opening and sealing the inside of the container;

removing means for removing the seal member and opening the opening;

a coupling member capable of coupling the removing means to a member outside said developer supplying device; and electrodes covered with the seal member.

8. An imaging device comprising:

a developer supplying device having a first container for containing developer and a first opening, a first seal member for closing the first opening and sealing the inside of the first container, and first removing means for removing the first seal member and opening the first opening; and an imaging cartridge having an image carrier having a surface on which an image of developer is formed, a second container for containing developer to be provided to the image carrier and having a second opening, a second seal member for closing the second opening and sealing the inside of the second container, and second removing means for removing the second seal member and opening the second opening;

wherein the developer supplying device is an independent unit attachable to the imaging cartridge; and in a state that the developer supplying device is attached to the imaging cartridge, the first opening faces to the second opening, and the first removing means is coupled to the second removing means.

9. The imaging device according to claim 8, wherein the developer supplying device has driving means for driving the first removing means.

10. The imaging device according to claim 9, wherein the developer supplying device includes:

removal locking means for typically locking the drive of the first removing means, being released by an external operation; and a cover member for covering the removal locking means, having an operation port for accepting the operation from the imaging cartridge, the imaging cartridge includes lock releasing means for releasing the removal locking means, and when the developer supplying device is attached to the imaging cartridge, the removal locking means is released by the lock releasing means.

11. The imaging device according to claim 8, wherein the imaging cartridge has driving means for driving the second removing means.

12. The imaging device according to claim 11, wherein the imaging cartridge includes:

removal locking means for typically locking the drive of the second removing means, and being released by an external operation, and a cover member for covering the removal locking means and having an operation port for accepting the operation from the developer supplying device, the developer supplying device includes the lock releasing means for releasing the removal locking means, and when the developer supplying device is attached to the imaging cartridge, the removal locking means is released by the lock releasing means.

13. The imaging device according to claim 8, wherein the developer supplying device has a conductive member covered with the first seal member and the imaging cartridge has electrodes covered with the second seal member.

14. The imaging device according to claim 13, wherein the electrodes function as an attachment completion sensor for sensing attachment of the developer supplying device to the imaging cartridge as well as removal of the first and second seal members.

15. An image forming device comprising:

an imaging cartridge detachable from the image forming device, accommodating developer therein in an initial amount when a developer supplying device is not attached thereto, and having an opening; and first image formation disabling means for disabling image formation until the developer supplying device is attached to the imaging cartridge to supply additional developer when the initial amount of developer in the imaging cartridge is reduced less than a predetermined amount without the developer supplying device being attached thereto.

16. The image forming device according to claim 15 has a second image formation disabling means for disabling image formation until the imaging cartridge is replaced with a new one when developer in the developer supplying device is reduced less than a predetermined amount.

17. An image forming device including:

a developer supplying device;

an imaging cartridge; and a first image formation disabling means, the developer supplying device including:

a first container for containing developer and having a first opening, a first seal member for closing the first opening and sealing the inside of the first container, and first removing means for removing the first seal member and opening the first opening, the imaging cartridge including:

an image carrier having a surface on which an image of a developer is formed, a second container for containing developer to be provided to the image carrier, having a second opening, a second seal member for closing the second opening and sealing the inside of the second container, and second removing means for removing the second seal member and opening the second opening, the first image formation disabling means disabling image formation until a developer supplying device is attached to the imaging cartridge when developer in the second container is reduced less than a predetermined amount, wherein the developer supplying device is an independent unit attachable to the imaging cartridge; and when the developer supplying device is attached to the imaging cartridge, the first opening faces to the second opening, and the first removing means is coupled to the second removing means.

18. The image forming device according to claim 17, wherein the developer supplying device has a conductive member covered with the first seal member and the imaging cartridge has electrodes covered with the second seal member.

19. The image forming device according to claim 18, wherein the electrodes function as an attachment completion sensor for sensing attachment of the developer supplying device to the imaging cartridge as well as removal of the first and second seal members.

20. A developer supplying device comprising:

a container for containing developer, having an opening;

a seal member for closing the opening and sealing the inside of the container;

removing means for removing the seal member and opening the opening;

a coupling member capable of coupling the removing means to a member separate from said developer supplying device;

a support shaft rotatably disposed in the container; and a flexible flap member mounted to the support shaft, for rotating together with the support shaft and thereby moving the developer present in the container toward a surface on which the opening is formed, wherein the flap member has inclined regions outside of an opposite range opposite to the opening, in which the farther from the opening the flap member is, the shorter the distance between the support shaft and the end of the flap member is.

21. The developer supplying device according to claim 20, wherein one or more slit is disposed on at least one border of the inclined regions.

* * * * *